United States Patent [19]

Lohre

[11] Patent Number: 4,892,303

[45] Date of Patent: Jan. 9, 1990

[54] SPORT FENCING DEVICE

[76] Inventor: Günther Lohre, Reinsburgstrasse 111, D-7000, Stuttgart 1, Fed. Rep. of Germany

[21] Appl. No.: 233,670

[22] Filed: Aug. 18, 1988

[30] Foreign Application Priority Data

Aug. 24, 1987 [DE] Fed. Rep. of Germany ..... 3728187

[51] Int. Cl.[4] ..... A63B 69/02

[52] U.S. Cl. ..... 272/98; 273/1 F; 446/473; 272/76

[58] Field of Search ..... 272/98, 93, 76, 77, 272/78; 273/1 F; 446/473

[56] References Cited

U.S. PATENT DOCUMENTS 1,276,959 8/1918 Riebe ..... 272/98
4,328,966 5/1982 Miyamoto ..... 273/1 F

FOREIGN PATENT DOCUMENTS 829106 1/1952 Fed. Rep. of Germany .
2454162 5/1976 Fed. Rep. of Germany .
2125302 3/1984 United Kingdom ..... 272/76

OTHER PUBLICATIONS

Softside, Feb., 1982, pp. 10–11, "Light Sabers and Lasers", by Wold et al.
Family Weekly, Dec., 1975, pg. 15, "Boffers at Play".
"Sport and Mode", 1973, p. 22.

*Primary Examiner*—Richard J. Apley
*Assistant Examiner*—J. Welsh
*Attorney, Agent, or Firm*—Marmorek, Guttman & Rubenstein

[57] ABSTRACT

A sport fencing device comprises an oblong striking element made from a foam material, a handle attached to the striking element, and a stabilizing element interconnecting the handle with the striking element. The sport fencing device further includes a contact detector, for example, a pressure sensitive switch located in the forward end of the striking element. When the forward end of the striking element makes contact with an opponent's body, the switch is closed and a point is scored.

14 Claims, 1 Drawing Sheet

SPORT FENCING DEVICE

BACKGROUND AND SUMMARY OF THE INVENTION

The instant invention relates to a sport fencing device.

It is an object of the invention to provide a sport fencing device making it possible to achieve the dexterity requirements of fencing in which points are scored by touching the opponent with the device, and yet without requiring protective devices (screened helmets, slash and stab-proof vests, etc.). At the same time, it is desirable that an indication be provided when points are scored by touching the opponent.

These objects are achieved in a sport fencing device which comprises an oblong striking element, a handle attached to the striking element, and a stabilizing element extending from the handle at least one-third of the way into the striking element. The oblong striking element is made from a synthetic foam material. The sport fencing device further includes a pressure sensitive switch located in the striking element at the end away from the handle. The pressure sensitive switch is actuated when a touch is made and an indication device is provided in the handle which records when a touch has been made and a point scored.

The invention thus creates a new and simple sport device in which the highest requirements of dexterity can be made, but which is at the same time so safe that the sport can be engaged in without the protective devices required in "normal" fencing.

BRIEF DESCRIPTION OF THE DRAWINGS

An embodiment of the invention and of its advantageous further developments are described below with reference to the attached drawings wherein.

DETAILED DESCRIPTION OF PREFERRED EMBODIMENTS

Figure 1:
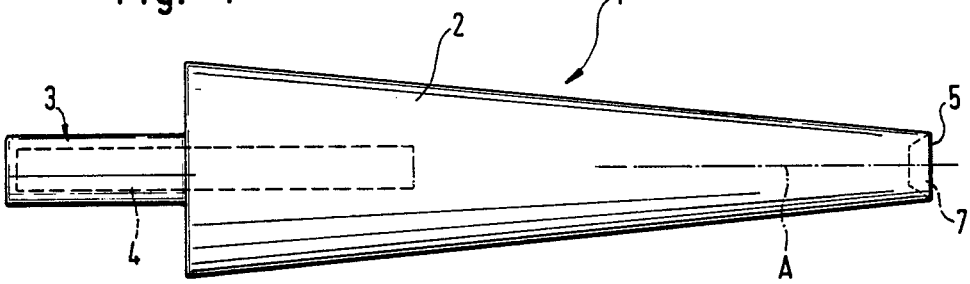
FIG. 1 shows an embodiment of the sport fencing device of the present invention.

Referring to the drawings, a sport fencing device 1 is constituted by a striking element 2 and by a handle 3 attached thereto. The striking element 2 is made from an extruded foam material such as a polyether, polyester or polyethylene foam, having a specific weight between about 25 and 40 kg/cm$^3$ and a strain hardness of about 2.5 to 6.0 kgPascal. As can be seen, the striking element 2 is shaped as a dynamically balanced, conical body having the following exemplary dimensions: length 61 cm, diameter at the wide end 15 cm, diameter in front, i.e., at the narrow end, 6.5 cm.

A wooden dowel 4 is integrated in the handle 3 and in the third of the striking element 2 nearest to the handle. The wooden dowel 4 provides a secure hold in the area of the handle when it is grasped and also stabilizes the striking element 2.

Figure 2:
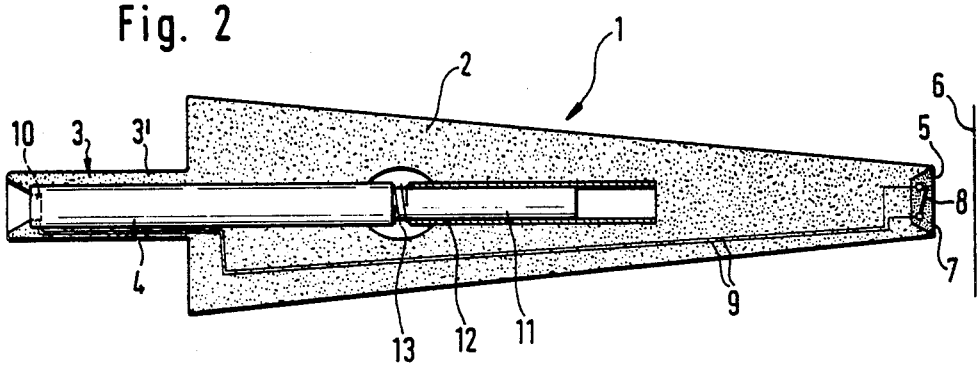
FIG. 2 is a sectional view through the embodiment shown in FIG. 1, with modifications.
Figure 3:
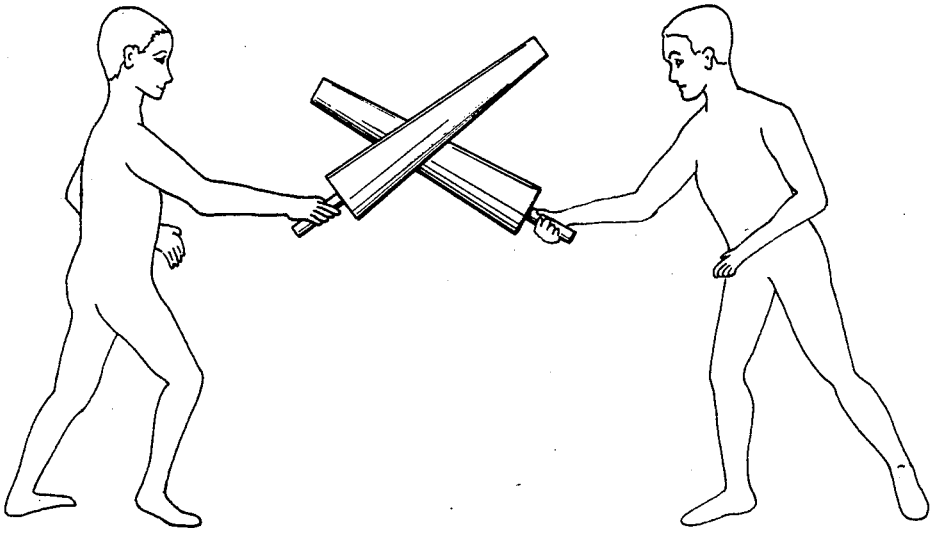
FIG. 3 shows two persons fencing with the sport fencing device according to the present invention.

The sport fencing device 1 is used in the manner shown in FIG. 3. Two persons opposing each other each grip the sport fencing device by the handle 3. As many points as possible are to be scored by touching the body of the opponent. Any lunge in the direction of the longitudinal axis A of the sport fencing device which culminates in a touch, counts as a point. Thus, when the forward face 5 of the striking element 2 touches the body of the opponent whose surface is indicated schematically in FIG. 2 by the reference numeral 6, a point is scored.

To be able to identify beyond any doubt when a point is scored with the forward face 5 of the sport fencing device 1, a contact detector 7 is integrated into the forward face 5. Contact detector 7 may comprise, in its simplest form, a pressure sensitive switch 8 for example, embedded in the foam material. Switch 8 closes when a contact is made by the face 5 along the longitudinal axis A, resulting in an electric impulse being generated in a known manner. In order to register this impulse, the contact detector 7 is connected via a circuit 9 to an indicator device 10 located in the end face at the handle 3. The indicating device 10 is fashioned so that it indicates numerically and in an easily readable manner the number of points that have been scored. It also contains other desirable electrical or switching devices, e.g., batteries, a counter switch, a return-to-zero device, etc.

In the embodiment illustrated in FIG. 2, two telescope-like tubes 11 and 12 capable of being pushed into each other follow the wooden dowel 4. The outer tube 12 slides over the inner tube 11 which is connected to the wooden dowel 4. Between the wooden dowel 4 and the tube 12 is a spring 13. By this means, the entire striking element 2 is provided with additional resistance against being bent, even beyond the reach of the wooden dowel.

In making the striking element 2 of extruded foam which integrally extends to become a covering 3' for the wooden dowel 4 near the handle 3, care must be taken that the outer surface of the extruded foam body is made with closed cells, i.e., that extrusion is effected in such manner that a tight surface is created to serve as the outer skin. If this is done, the striking element 2 will not soak up moisture, for example, perspiration from the hand particularly in the region of covering 3'. The closed structure of the outer skin also improves the resistance of the outer surface to tearing.

While the invention has been described by reference to specific embodiments, this was for purposes of illustration only and should not be construed to limit the spirit or the scope of the invention.

I claim:

1. A sport fencing device, comprising an oblong striking element including a longitudinal axis made from a foam material, said striking element being conic in shape and including a narrow end and a wide end, said narrow end including an end face, a handle attached to said striking element adjacent said wide end, a stabilizing element interconnecting said striking element with said handle, said stabilizing element extending approximately one-third of the way into said striking element, and electronic hit detection means integrated into said end face for detecting when said end face makes a hit with a surface along said longitudinal axis.

2. The sport fencing device of claim 1 wherein said electronic detection means comprises a pressure sensitive switch.

3. The sport fencing device of claim 2 further comprising indication means connected to said pressure sensitive switch for indicating when said pressure sensitive switch is actuated.

4. The sport fencing device of claim 3 wherein said indication means are integrated into in said handle.

5. The sport fencing device of claim 1 wherein said stabilizing element comprises a dowel.

6. The sport fencing device of claim 5 wherein said stabilizing element includes telescoping tubes axially aligned with said dowel, and spring means disposed between said dowel and said telescoping tubes.

7. The sport fencing device of claim 1 wherein said striking element includes an outer skin made from said foam material having closed cells.

8. A sport fencing device comprising an oblong striking element made from a foam material, said striking element being conic in shape and including a narrow end and a wide end, a handle attached to said striking element adjacent said wide end, a stabilizing element interconnecting said striking element with said handle, said stabilizing element comprising a dowel and telescoping tubes axially aligned with said dowel, and spring means disposed between said dowel and said telescoping tubes, and contact detection means disposed in said narrow end for detecting when said narrow end makes contact with a surface.

9. The sport fencing device of claim 8 wherein said stabilizing element extends approximately one-third of the way into said striking element.

10. The sport fencing device of claim 8 wherein said striking element includes a longitudinal axis, said contact detection means detecting when said narrow end makes contact with a surface along said longitudinal axis.

11. The sport fencing device of claim 8 wherein said contact detection means comprises a pressure sensitive switch.

12. The sport fencing device of claim 11 further comprising indication means connected to said pressure sensitive switch for indicating when said pressure sensitive switch is actuated.

13. The sport fencing device of claim 12 wherein said indication means are disposed in said handle.

14. The sport fencing device of claim 8 wherein said striking element includes an outer skin made from said foam material having closed cells.

* * * * *